US005135096A

United States Patent [19]

Ward, II

[11] Patent Number: 5,135,096

[45] Date of Patent: Aug. 4, 1992

[54] COIN VALIDATING APPARATUS FOR ELECTRONIC PARKING METER

[75] Inventor: Seth Ward, II, Russellville, Ark.

[73] Assignee: POM Incorporated, Russellville, Ark.

[21] Appl. No.: 622,612

[22] Filed: Dec. 5, 1990

[51] Int. Cl.[5] ..... G07F 17/24

[52] U.S. Cl. ..... 194/224; 194/310

[58] Field of Search ..... 194/213, 224, 229, 307, 194/308, 310

[56] References Cited

U.S. PATENT DOCUMENTS

| | | | |
|---|---|---|---|
| 922,045 | 5/1909 | Roland | 194/308 |
| 3,948,375 | 4/1976 | Selby, Jr. | 194/216 |
| 4,792,032 | 12/1988 | Shapiro | 194/243 |
| 4,823,928 | 4/1989 | Speas | 194/217 |
| 4,827,206 | 5/1989 | Speas | 323/299 |
| 4,872,149 | 10/1989 | Speas | 368/90 |
| 4,880,097 | 11/1989 | Speas | 194/239 |
| 4,895,238 | 1/1990 | Speas | 194/319 |

*Primary Examiner*—F. J. Bartuska

*Attorney, Agent, or Firm*—Hill, Van Santen, Steadman & Simpson

[57] ABSTRACT

A coin validating apparatus having a coin carriage for moving the coin along at least one coin track. The coin carriage has at least an electrically conductive portion in contact with the coin. The coin track has at least one cam at a predetermined location, the cam having at least a substantially non-conductive base portion attached to the coin track and an electrically conductive top portion. A component for detecting current is connected in series with the top portion in a first terminal of a voltage souorce. A second terminal of the voltage source is connected to the electrically conductive portion of the coin carriage. The coin completes an electrical connection between the electrically conductive portion of the coin carriage and the top portion of the cam when the coin carriage has positioned the coin over the cam and when the coin is electrically conductive. When the coin comnpletes the electrical connection, the component for detecting provides a signal indicative thereof.

20 Claims, 5 Drawing Sheets

COIN VALIDATING APPARATUS FOR ELECTRONIC PARKING METER

BACKGROUND OF THE INVENTION

This invention relates in general to electronic timing devices and, in particular, to electronic parking meters.

Both mechanical and electronic parking meters are well known in the prior art and are typically of the type which are responsive to the insertion of a coin to begin timing an interval for a vehicle parked in an appropriate space associated with the parking meter. The timing interval is typically determined by the number and value of the coins which are inserted into the parking meter. The parking meter can be associated with a single parking space or a single parking meter may be used for an entire lot of multiple spaces.

It is a feature of the present invention to provide an electronic parking meter which is more dependable, has a greater variety of features, and is more economical to manufacture than prior art parking meters. It is an advantage of the present invention that the novel electronic parking meter can identify and reject non-metallic coins.

U.S. Pat. No. 4,792,032 discloses a parking meter which has a coin carriage that moves a deposited coin on a coin track having cam surfaces. When the coin is moved over the cam surface a switch is activated and provides a signal to the electronic circuitry in the parking meter. A drawback of such a structure is that non-metallic coin-shaped elements can be used to activate the parking meter. U.S. Pat. No. 4,792,032 is hereby incorporated by reference in regards to the structure depicted in FIG. 2A of this patent. U.S. Pat. No. 3,757,916 depicts in FIG. 7 thereof another version of a coin winding mechanism.

SUMMARY OF THE INVENTION

It is an object of the presnt invention to provide an improved coin validating apparatus for use in an electronic parking meter.

It is a further object of the present inventio to provide a coin validating apparatus for determining if a coin inserted in the electronic parking meter is electrialy conductivre.

The prsent invention involves a coin validating apparatus having a means for moving the coin along at least one coin track. The means for moving has at least an electrically conductive portion in contact with the coin. The coin track has at least one cam at a predetermined location, in one embodiment the cam having at least a substntially non-conductive base portion attached to the coin track and an electrically conductive top portion. A means for detecting current is connected in series with the top portion and a first terminal of a voltage source. A second terminal of the voltage source is connected to the electrically conductive portion of the means for moving. The coin completes an electrical connection between the electrically conductive portion of the means for moving and the top portion of the cam when the means for moving has positioned the coin over the cam and when the coin is electrically conductive. When the coin completes the electrical connection, the means for detecting provides a signal indicative thereof.

The coin track in one embodiment comprises an electrically non-conductive material and the cam does not have the substantially non-conductive base portion. In another embodiment wherein the cam has the substantially non-conductive base portion, the coin track is electrically connected to the second terminal of the voltage source. The means for moving in the preferred embodiment is a coin carriage rotatable about a pivot location and the coin track is a segment of a circle having a center corresponding to the pivot location. Also, in the preferred embodiment the means for detecting current is a resistance element connected between the top portion and the first terminal of the voltage source, the signal being taken for the juncture of the resistance element and the top portion.

The present invention can also have a plurality of parallel coin tracks each having at least one cam. For this embodiment, the means for moving has a plurality of slots for holding different types of coins in a predetermined relationship to predetermined coin tracks of the plurality of coin tracks.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
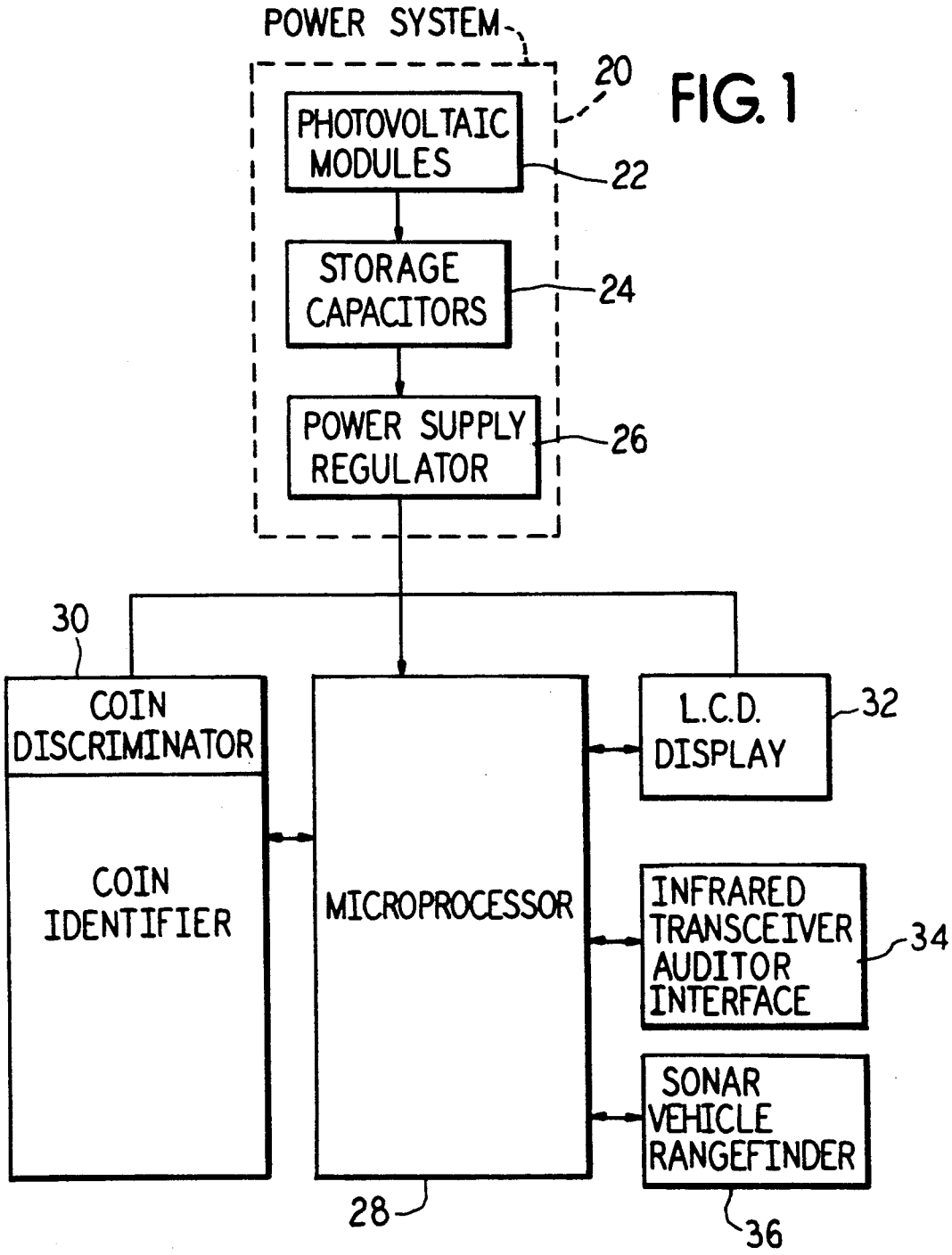
FIG. 1 is a general block diagram of an electronic parking meter having the coin validating apparatus of the present invention.

The present invention has general applicability but is most advantageously utilized in a parking meter associated with a space in which a vehicle may park. It is to be understood, however, that the present invention or portions thereof may be used for a variety of different applications wherever a paid timing function is to be utilized.

In generally terms, the novel electronic parking meter system of the present invention is utilized to receive one or more type of coins. It is to be understood, however, that the meter could also be adapted to receive paper money or a credit card. The electronic parking meter has a power supply which is connected to a microprocessor which has a memory. The microprocessor typically has a power-up mode, a standby mode and an operational mode. A coin signal generator produces a coin signal upon receipt of a coin by the meter. After receiving the coin signal, an interrupt logic circuit places the microprocessor in the operational mode from the standby mode. An oscillator is connected to the microprocessor and to the interrupt logic circuit. An electronic display is connected to the microprocessor for displaying pertinent information such as money deposited, time remaining on the meter, etc.

The meter also has a reset logic circuit for placing the microprocessor in a power-up mode which is typically utilized when the meter is first placed in operation. The reset logic circuit is connected at least to the microprocessor. Furthermore, the meter may have an interface for connecting an auditor. The microprocessor and the auditor exchange information such as programming of the microprocessor from the auditor and sending data from the microprocessor to the auditor regarding money deposited in the meter and other operational parameters.

In addition, the meter may also have a sonar range finder system which detects the presence or absence of a vehicle in an associated parking space. The sonar range finder system is connected to the microprocessor for operation.

When the electronic parking meter is first placed into operation, the reset circuitry is activated, for example, by the auditor, and causes the microprocessor to be placed in a power-up mode. During the power-up mode, the microprocessor performs diagnostic tests on the components of the meter and also initializes any appropriate circuitry in the meter. In addition, an oscillatory is activated and runs at a fixed frequency. When the power-up mode is complete, the microprocessor is placed in a standby mode in which it is still connected with the power supply of the meter. Also, during the standby mode, the oscillator continues to be operational. When a coin is placed into the meter a signal is sent to the microprocessor which causes it to change from the standby mode to the operational mode. Coin detectors send appropriate signals to the microprocessor. The information regarding the amount of coins entered into the meter and the amount of time the meter will run, as well as, any other pertinent parameters is displayed on a display device connected to the microprocessor. During the timing function of the meter, the microprocessor is intermittently placed in the operational mode from the standby mode to update the time display and to identify when the timing has reached zero. Furthermore, the time display has an additional internal oscillator which may be instructed to flash an element of the display, such as a no parking signal, while the microprocessor is in the standby mode.

When the meter is equipped with a sonar range finder, the microprocessor, when it intermittently enters the operational mode, will cause the sonar range finder to determine if the vehicle is still present in the associated space. If the vehicle is not detected, the microprocessor then causes the meter to return to zero.

The auditor unit is utilized to exchange data and information with the parking meter. Typically, this would include programming the parking meter to change the amount of time per type of coin inserted in the meter, and to collect data from the meter, such as the amount of money deposited and operational parameters of the meter. The auditor unit may be a hand-held general purpose computer which is equipped either with a cable for direct connection to the meter or with an infrared transmitter receiver system so that the auditor may be interfaced to the electronic parking meter from a distance. This is advantageous when an attendant desires to interface with the electronic parking meter while remaining in a vehicle. When the auditor unit is connected by cable to the electronic parking meter, the cable may be utilized to provide electrical power to the meter to recharge the meter's power supply or to activate the microprocessor.

The above-identified features are disclosed and claimed in U.S. Pat. Nos. 4,823,928; 4,827,206; 4,872,149; 4,880,097; 4,895,238; and U.S. Ser. No. 254,279, now allowed (all of which are hereby incorporated by reference).

FIG. 1 shows a general block diagram of the electronic parking meter system. A power supply 20 has, in the preferred embodiment, solar cell arrays 22 for providing a cell voltage to a series of storage capacitors 24. The cell voltage causes the storage capacitors 24 to be charged to a capacitor voltage. A power supply regulator 26 is connected to the storage capacitors 24 and provides a regulated voltage for use by the electronic parking meter components.

Central to the electronic parking meter is a microprocessor 28. The microprocessor 28 is connected to a coin identifier 30 which sends a signal to the microprocessor when a valid metallic coin is received by the meter. The microprocessor 28 also receives at least one signal from the coin identifier 30 which identifies the type of coin received by the meter. After the microprocessor 28 has determined the type of coin deposited, the microprocessor 28 displays the pertinent information in a liquid crystal display unit 32.

As discussed above, an auditor having an infrared transceiver 34 may be interfaced with the microprocessor 28 of the electronic parking meter. Also, a sonar range finder 36 may be connected to the microprocessor 28.

Figure 2:
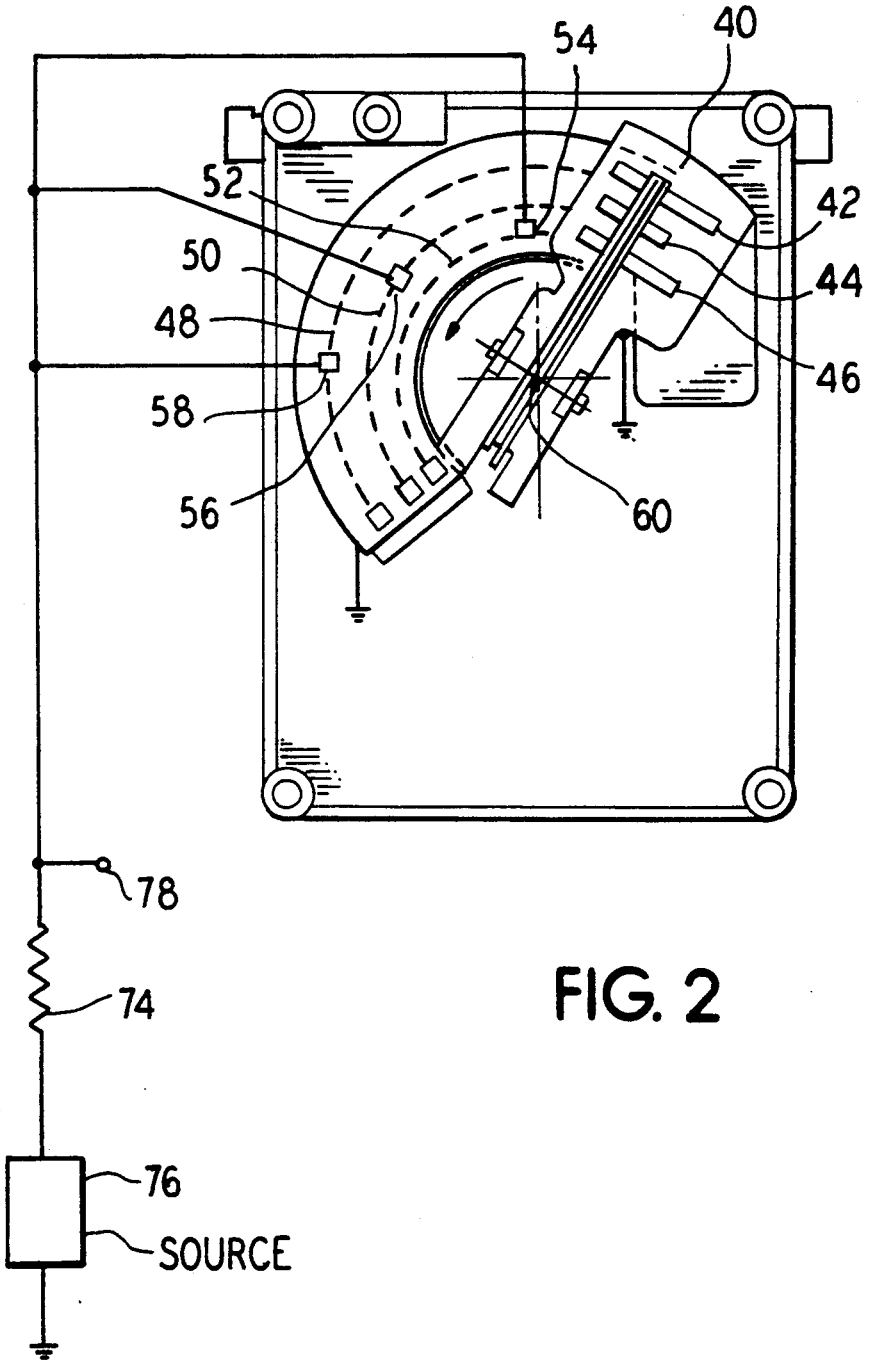
FIG. 2 is a schematic illustration of one embodiment of the coin validating apparatus.
Figure 4:
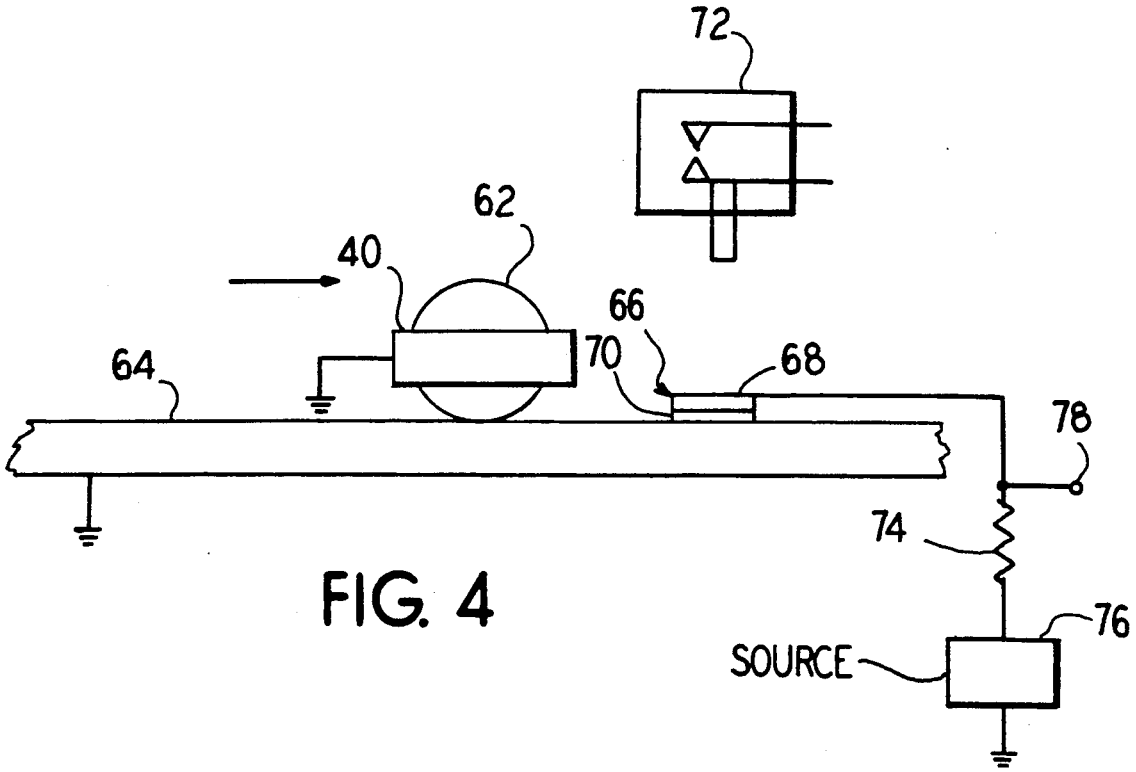
FIGS. 4 and 5 schematically depict the operation of a coin validating apparatus wherein a cam on a coin track has an insulated base portion.
Figure 5:
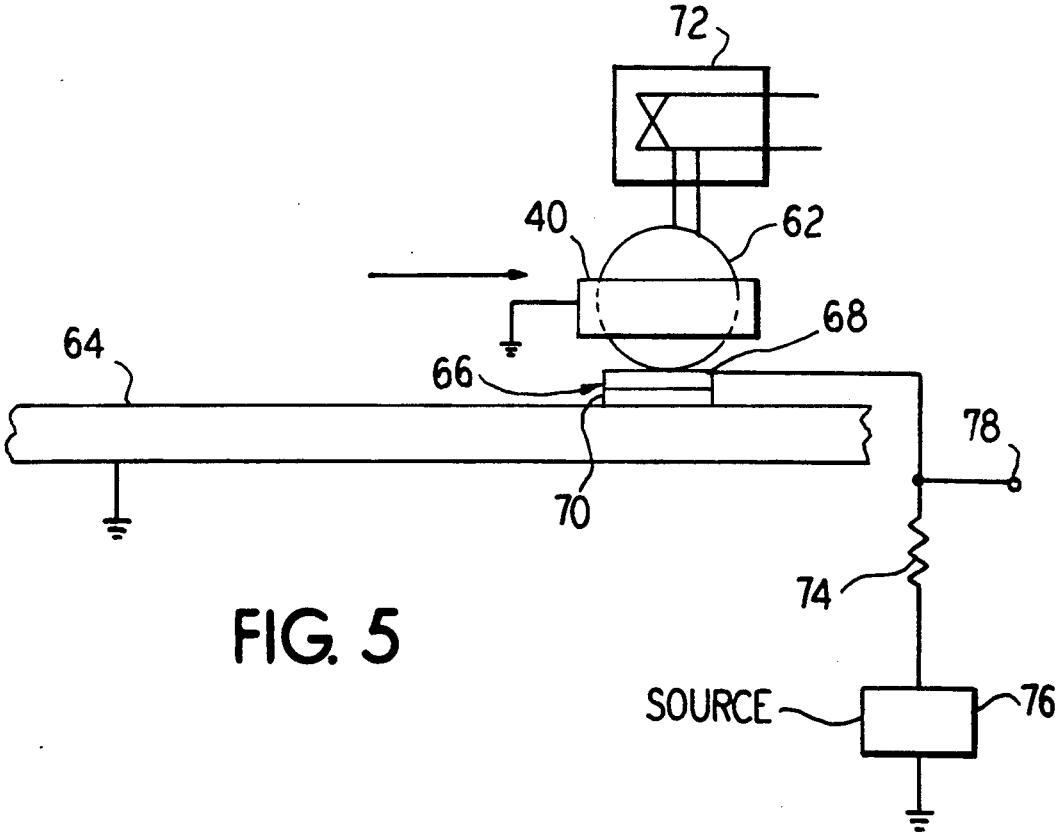

FIG. 2 schematically depicts the coin validating apparatus of the present invention which is used in the coin identifier 30 depicted in FIG. 1. The coin validating apparatus has a coin carriage 40. In the preferred embodiment the coin carriage 40 has a plurality of slots 42, 44 and 46 which hold different types of coins in predetermined relationship to a plurality of coin tracks 48, 50 and 52. Each of the coin tracks 48, 50 and 52 has a cam 54, 56 and 58 respectively attached thereto at predetermined locations. The coin carriage 40 is rotatable about a pivot location 60 and the coin tracks 48, 50 and 52 are segments of circles having a common center corresponding to the pivot location 60. As is known in the art the coin carriage 40 is rotated about the pivot location 60 carrying a coin in one of its slots 42, 44 and 46. When the coin is positioned by the coin carriage 40 over the respective cam on the coin track the, coin is raised upward to engage a switching device and thereby identifying to the microprocessor 28 the type of coin received by the electronic parking meter. This operation is also depicted in FIGS. 4 and 5. In FIG. 4 the coin carriage 40 contains the coin 62 and is moving the coin 62 along the coin track 64. The cam 66 has an electrically conductive top portion 68 and a substantially nonconductive base portion 70. When the coin carriage 40 positions the coin 62 on the top portion 68 of the cam 66, the coin 62 is raised up to activate the switching element 72 thereby providing an electrical signal to the microprocess 28.

The top portion 68 of the cam 66 is connected via a pull-up resistor 74 to a voltage source 76. Terminal 78 is connected to the juncture of the pull-up resistor 74 and the top portion 68. When the coin 62, as shown in FIG. 5, engages the top portion 68 an electrical connection is made from the voltage source 76 through the pull-up resistor 74, through the top portion 68 of the cam 66, through the coin 62, and through the coin carriage 40 which is in turn connected back to the voltage source 76 through ground. Current then flows through the circuit and a voltage is developed at terminal 78 thereby providing a signal to the microprocessor 28 indicating that the coin is electrically conductive. Thus, the present invention is able to distinguish between a metallic coin and a non-metallic coin, such as plastic, which may be inserted into the electronic parking meter. In this embodiment of the present invention the coin track 64 is also connected to the voltage source 76 through ground.

Figure 3:
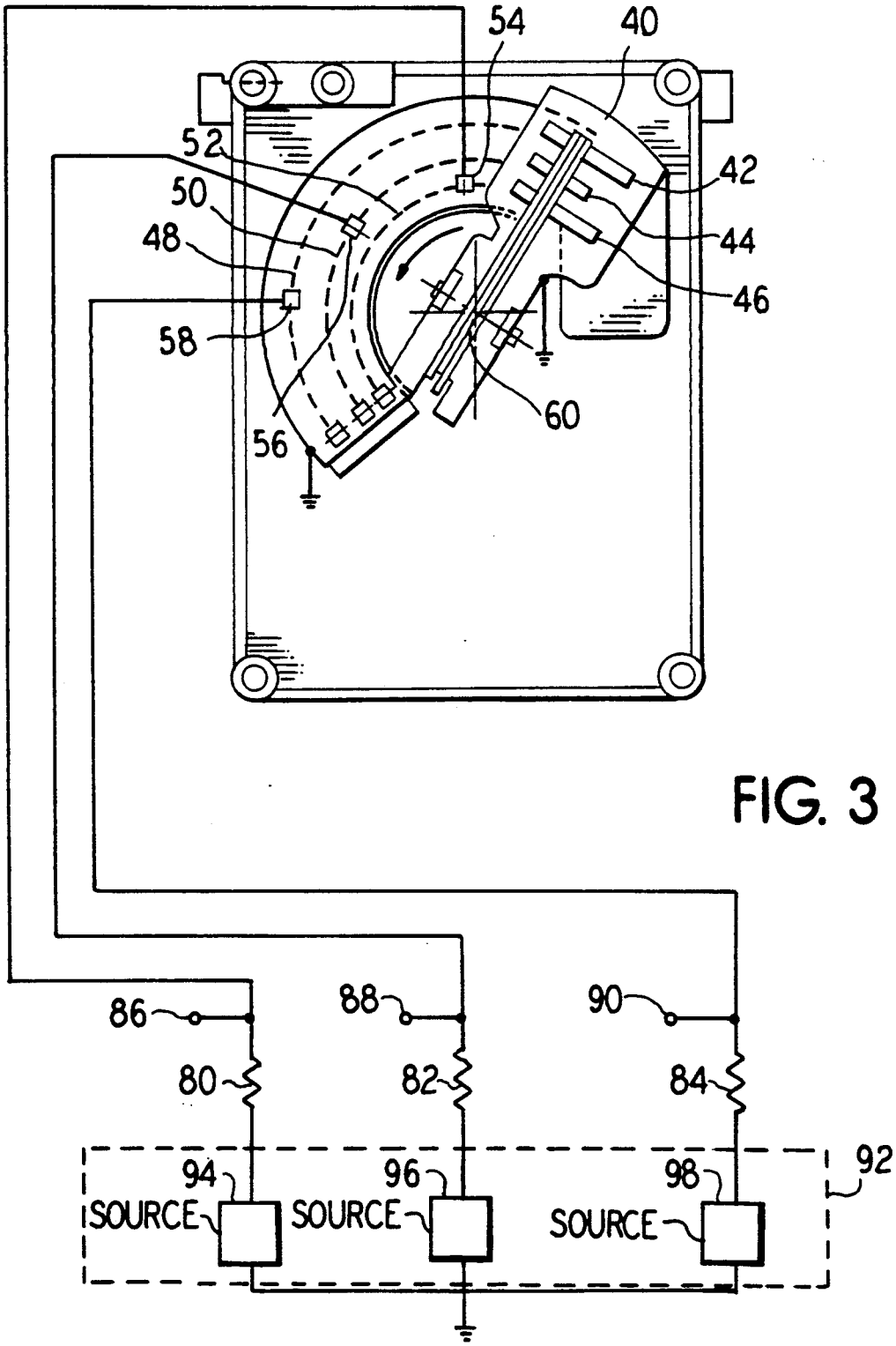
FIG. 3 is a schematic drawing of an alternative embodiment of the coin validating apparatus.

FIG. 3 depicts an alternative embodiment of the present invention wherein each cam 54, 56 and 58 is connected to a respective pull-up resistor 80, 82 and 84 having respective output terminals 86, 88 and 90. The pull-up resistors 80, 82 and 84 may be connected to a common means 92 for providing a voltage source or alternatively the means 92 may consist of individual voltage sources 94, 96 and 98.

Figure 6:
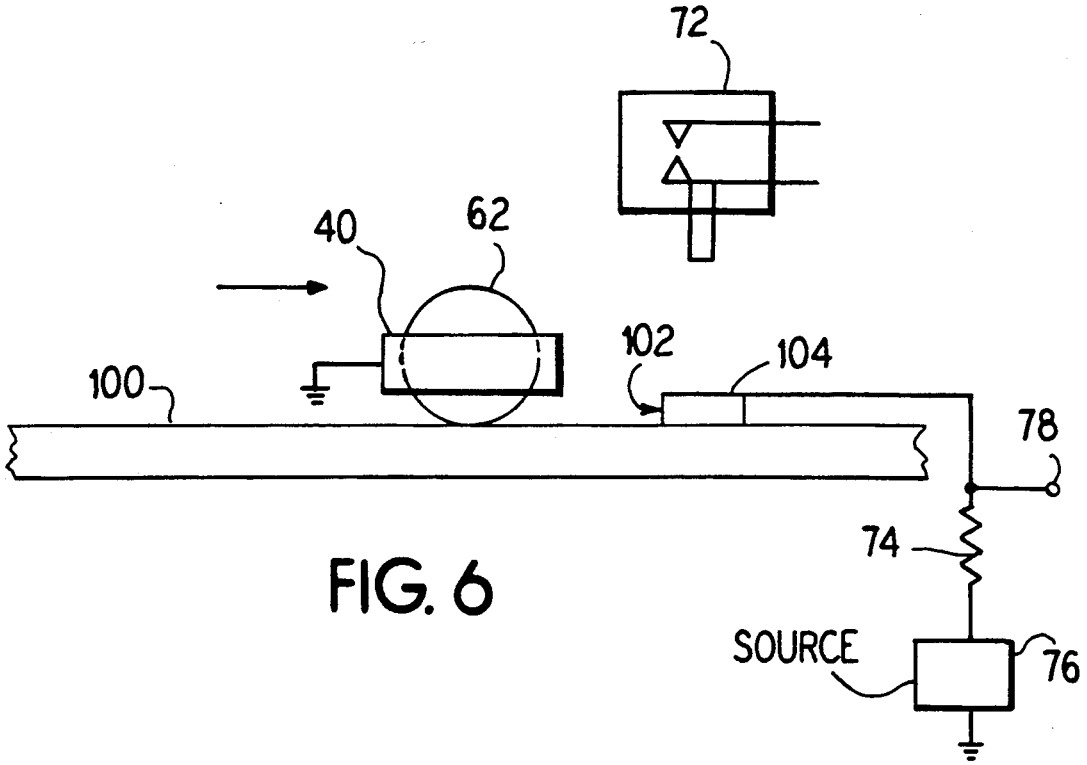
FIGS. 6 and 7 schematically depict the operation of a coin validating apparatus wherein the cam is positioned on a substantially non-conductive coin track.
Figure 7:
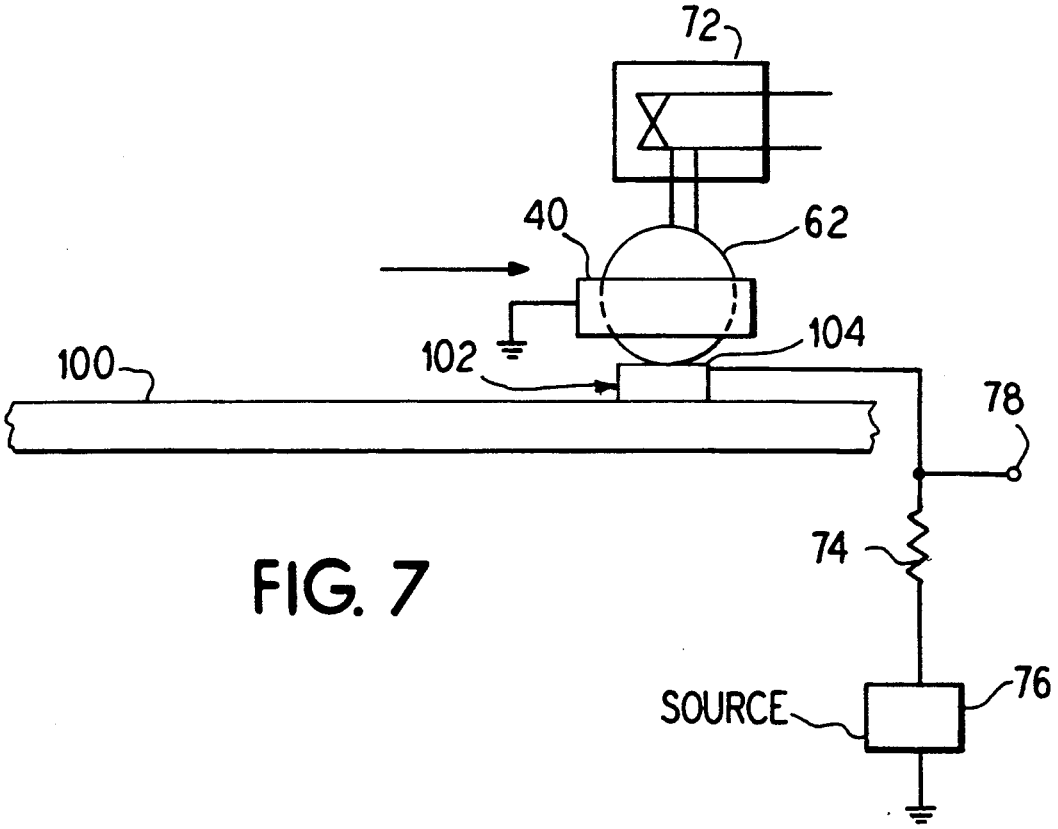

FIGS. 6 and 7 depict yet another alternative embodiment of the present invention wherein the coin track 100 is formed from a substantially non-conductive material. In this embodiment the cam 102 has no insulating base portion and therefore may be either entirely metallic or may have only an upper surface 104 coated with an electrically conductive layer to which the pull-up resistor 74 is connected. It is encompassed by the present invention that other means for detecting current flowing in the circuit can be used instead of the pull-up resistor 74. Furthermore, it is to be understood that the term "voltage source" in reference to the voltage source 76, for example, is to be considered to be any type of source for providing current for operating the circuit when the coin 62 establishes the electrical connection between the coin carriage 64 and the cam 66, 102 on the coin track 64, 100.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A coin validating apparatus for use in an electronic parking meter operable by at least one type of coin and for determining if a coin inserted in the electronic parking meter is electrically conductive, comprising:

means for moving the coin along at least one coin track, said means for moving having at least an electrically conductive portion in contact with the coin;

at least one cam on said coin track at a predetermined location, said cam having at least a substantially non-conductive base portion attached to said coin track and an electrically conductive top portion;

means for detecting current connected in series with said top portion and a first terminal of a means for providing at least one voltage source, a second terminal of said means for providing at least one voltage source connected to said electrically conductive portion of said means for moving;

the coin completing an electrical connection between said electrically conductive portion of said means for moving and said top portion of said cam when said means for moving has positioned the coin over said cam and when the coin is electrically conductive, and when the coin completes said electrical connection said means for detecting provides a signal indicative thereof.

2. The coin validating apparatus according to claim 1, wherein said coin track comprises an electrically non-conductive material.

3. The coin validating apparatus according to claim 1, wherein said coin track is electrically connected to said second terminal of said means for providing at least one voltage source.

4. The coin validating apparatus according to claim 1, wherein said means for moving is a coin carriage rotatable about a pivot location and wherein said coin track is a segment of a circle having a center corresponding to said pivot location.

5. The coin validating apparatus according to claim 1, wherein said means for detecting current is a resistance element connected between said top portion and said first terminal of said means for providing at least one voltage source, said signal being taken from the juncture of said resistance element and said top portion.

6. The coin validating apparatus according to claim 1, wherein said coin validating apparatus comprises a plurality of parallel coin tracks each having at least one cam, and wherein said means for moving has a plurality of slots for holding different types of coins in predetermined relationship to predetermined coin tracks of said plurality of coin tracks.

7. The coin validating apparatus according to claim 6, wherein said means for detecting current is connected to each of said top portions of said cams on said plurality of coin tracks.

8. The coin validating apparatus according to claim 6, wherein said means for detecting current is a plurality of resistance elements connected in a one-to-one correspondence from said top portions of said cams on said plurality of coin tracks to said first terminal of said means for providing at least one voltage source.

9. The coin validating apparatus according to claim 6, wherein said means for providing at least one voltage source comprises a plurality of voltage sources, and wherein said means for detecting current is a plurality of resistance elements connected in a one-to-one correspondence between said top portions of said cams on said plurality of coin tracks and said plurality of voltage sources.

10. A coin validating apparatus for use in an electronic parking meter operable by at least one type of coin and for determining if a coin inserted in the electronic parking meter is electrically conductive, comprising:

electrically conductive coin carriage for moving the coin along at least one coin track, said coin carriage being rotatable about a pivot location and said at least one coin track being a segment of a circle having a center corresponding to said pivot location;

at least one cam on said coin track at a predetermined location, said cam having at least a substantially non-conductive base portion attached to said coin track and an electrically conductive top portion;

a resistance element connected in series with said top portion and a first terminal of a means for providing a voltage source, a second terminal of said means for providing a voltage source connected to said coin carriage;

said coin completing an electrical connection between said coin carriage and said top portion of said cam when said coin carriage has positioned said coin over said cam and when said coin is electrically conductive, and when said coin completes said electrical connection said resistance element provides a signal indicative thereof at the juncture of said resistance element and said top portion.

11. The coin validating apparatus according to claim 10, wherein said coin track comprises an electrically non-conductive material.

12. The coin validating apparatus according to claim 10, wherein said coin track is electrically connected to said second terminal of said means for providing a voltage source.

13. A coin validating apparatus for use in an electronic parking meter operable by at least one type of coin and for determining if a coin inserted in the electronic parking meter is electrically conductive, comprising:

means for moving the coin along one predetermined coin track of a plurality of coin tracks, said means for moving having at least an electrically conductive portion in contact with the coin and said means for moving also having a plurality of slots for holding different types of coins in predetermined relationship to predetermined coin tracks of said parallel of coin tracks;

at least one cam on each of said coin tracks at predetermined locations, each of said cams having at least a substantially non-conductive base portion attached to said coin track and an electrically conductive top portion;

means for detecting current connected in series with each of said top portions and a first terminal of a means for providing a voltage source, a second terminal of said means for providing a voltage source connected to said electrically conductive portion of said means for moving;

said coin completing an electrical connection between said electrically conductive portion of said means for moving and a top portion of a cam on said one predetermined coin track when said means for moving has positioned said coin over said cam on said one predetermined coin track and when said coin is electrically conductive, and when said coin completes said electrical connection said means for detecting provides a signal indicative thereof.

14. The coin validating apparatus according to claim 13, wherein said coin track is electrically connected to said second terminal of said means for providing a voltage source.

15. The coin validating apparatus according to claim 13, wherein said means for detecting current is a resistance element connected from said top portions of said cams on said plurality of coin tracks to said first terminal of said means for providing a voltage source.

16. A coin validating apparatus for use in an electronic parking meter operable by at least one type of coin and for determining if a coin inserted in the electronic parking meter is electrically conductive, comprising:

means for moving the coin along at least one substantially electrically non-conductive coin track, said means for moving having at least an electrically conductive portion in contact with the coin;

at least one cam on said coin track at a predetermined location, said cam having at least an electrically conductive top portion;

means for detecting current connected in series with said top portion and a first terminal of a means for providing at least one voltage source, a second terminal of said means for providing at least one voltage source connected to said electrically conductive portion of said means for moving;

the coin completing an electrical connection between said electrically conductive portion of said means for moving and said top portion of said cam when said means for moving has positioned the coin over said cam and when the coin is electrically conductive, and when the coin completes said electrical connection said means for detecting provides a signal indicative thereof.

17. The coin validating apparatus according to claim 16, wherein said means for moving is a coin carriage rotatable about a pivot location and wherein said coin track is a segment of a circle having a center corresponding to said pivot location.

18. The coin validating apparatus according to claim 16, wherein said means for detecting current is a resistance element connected between said top portion and said first terminal of said means for providing at least one voltage source, said signal being taken from the juncture of said resistance element and said top portion.

19. The coin validating apparatus according to claim 16, wherein said coin validating apparatus comprises a plurality of parallel coin tracks each having at least one cam, and wherein said means for moving has a plurality of slots for holding different types of coins in predetermined relationship to predetermined coin tracks of said plurality of coin tracks.

20. The coin validating apparatus according to claim 19, wherein said means for detecting current is connected to each of said top portions of said cams on said plurality of coin tracks.

* * * * *